US012601497B2

(12) United States Patent
Allgyer

(10) Patent No.: US 12,601,497 B2
(45) Date of Patent: Apr. 14, 2026

(54) FIRE PIT SUPPORT

(71) Applicant: Breeo, LLC, Kinzers, PA (US)

(72) Inventor: Amos Alan Allgyer, Gordonville, PA (US)

(73) Assignee: Breeo, LLC, Kinzers, PA (US)

( * ) Notice: Subject to any disclaimer, the term of this patent is extended or adjusted under 35 U.S.C. 154(b) by 419 days.

(21) Appl. No.: 18/206,675

(22) Filed: Jun. 7, 2023

(65) Prior Publication Data

US 2024/0035660 A1 Feb. 1, 2024

Related U.S. Application Data

(60) Provisional application No. 63/393,138, filed on Jul. 28, 2022.

(51) Int. Cl.
*F24B 1/195* (2006.01)
*F24B 1/189* (2006.01)

(52) U.S. Cl.
CPC ..... *F24B 1/1957* (2013.01); *F24B 1/189* (2013.01)

(58) Field of Classification Search
CPC ..... F24B 1/1957
USPC ..... 126/279; 248/346.3
See application file for complete search history.

(56) References Cited

U.S. PATENT DOCUMENTS

| | | | | |
|---|---|---|---|---|
| 124,039 | A | 2/1872 | Detwiler | |
| 133,231 | A | 11/1872 | Lapaire | |
| 137,291 | A | 4/1873 | Conger | |
| 159,659 | A | 2/1875 | Evans | |
| RE6,460 | E | 5/1875 | Brownell | |
| RE9,277 | E | 7/1880 | Detwiler | |
| 312,933 | A | 2/1885 | Hagen | |
| 374,235 | A | 12/1887 | Bassett | |
| 936,482 | A | 10/1909 | Seeley | |
| 1,005,462 | A | 10/1911 | Pearce | |
| 1,507,078 | A * | 9/1924 | Mackie | A47F 5/114 5/280 |

(Continued)

FOREIGN PATENT DOCUMENTS

| | | |
|---|---|---|
| CN | 302527850 | 8/2013 |
| CN | 208349349 U * | 1/2019 |

(Continued)

OTHER PUBLICATIONS

Breeo, LLC, Instagram, Jun. 26, 2022, accessed Jul. 12, 2022 from https://www.instagram.com/reel/CfRrlPdlhOa/.

(Continued)

*Primary Examiner* — Jorge A Pereiro
(74) *Attorney, Agent, or Firm* — Fred Zollinger

(57) ABSTRACT

A fire pit support is used between a fire pit and the underlying support surface. The fire pit support provides a heat shield that carries the fire pit above the underlying support surface while allowing air to circulate between the support surface and the heat shield. The fire pit support provides a raised lip about the perimeter of the heat shield to prevent the fire pit from unintentionally sliding off the edge of the fire pit support. The fire pit support includes water drainage openings that allow water to drain through the fire pit support. The drainage openings are configured to minimize heat that passes through the heat shield. The fire pit support can be shipped to the end user in a disassembled condition and readily erected by the end user using a typical screwdriver.

19 Claims, 5 Drawing Sheets

(56) References Cited

U.S. PATENT DOCUMENTS

| | | | | |
|---|---|---|---|---|
| 1,510,040 | A | 9/1924 | Carter | |
| D71,624 | S | 12/1926 | Rodler | |
| 1,962,833 | A * | 6/1934 | Nuckols | A47F 5/112 229/5.7 |
| RE26,123 | E | 12/1966 | Davis | |
| 3,765,397 | A | 10/1973 | Henderson | |
| 3,788,700 | A * | 1/1974 | Wartes | A47C 4/021 297/440.13 |
| 4,186,718 | A | 2/1980 | Goodwin | |
| 4,219,007 | A | 8/1980 | Peickert et al. | |
| D263,192 | S | 3/1982 | LeVan | |
| 4,416,251 | A | 11/1983 | Rachels, Sr. | |
| 4,909,235 | A | 3/1990 | Boetcker | |
| 5,687,704 | A | 11/1997 | Lerch et al. | |
| D392,753 | S | 3/1998 | Kohlberger et al. | |
| 5,842,463 | A | 12/1998 | Hall | |
| 5,915,371 | A | 6/1999 | Hering | |
| 5,970,858 | A | 10/1999 | Boehm et al. | |
| D444,996 | S | 7/2001 | Morgan | |
| 6,314,955 | B1 | 11/2001 | Boetcker | |
| 6,598,598 | B1 | 7/2003 | Bratsikas | |
| 6,615,821 | B1 | 9/2003 | Fisenko | |
| 6,619,749 | B2 * | 9/2003 | Willy | A47B 47/042 297/440.13 |
| D498,523 | S | 11/2004 | Davis | |
| D524,319 | S | 7/2006 | Zamanian | |
| 8,434,471 | B2 | 5/2013 | Jensen | |
| D701,721 | S | 4/2014 | Jan | |
| D723,146 | S | 2/2015 | Lawrence et al. | |
| D723,147 | S | 2/2015 | Lawrence et al. | |
| D723,148 | S | 2/2015 | Lawrence et al. | |
| D794,996 | S | 8/2017 | Nadal | |
| D821,810 | S | 7/2018 | Case et al. | |
| D822,188 | S | 7/2018 | Pontillas | |
| 10,058,210 | B2 | 8/2018 | Palermo | |
| D830,769 | S | 10/2018 | Wang | |
| 10,098,502 | B2 | 10/2018 | Ohler et al. | |
| 10,227,162 | B2 * | 3/2019 | Davis | A47B 47/042 |
| D849,907 | S * | 5/2019 | Zhou | D23/335 |
| D866,737 | S * | 11/2019 | Lyons, Jr. | D23/343 |
| D884,870 | S | 5/2020 | Bergin | |
| D948,681 | S | 4/2022 | Smith | |
| 11,293,642 | B2 | 4/2022 | Jan et al. | |
| D957,606 | S | 7/2022 | Martin | |
| D976,635 | S | 1/2023 | Xiao | |
| D979,736 | S | 2/2023 | Orcutt et al. | |
| D980,957 | S * | 3/2023 | Hong | D23/332 |
| D1,005,462 | S | 11/2023 | Jiang | |
| 2002/0157306 | A1 | 10/2002 | Mathew et al. | |
| 2003/0029442 | A1 | 2/2003 | Davis et al. | |
| 2007/0039603 | A1 | 2/2007 | Lindsly et al. | |
| 2012/0037149 | A1 | 2/2012 | Jensen | |
| 2012/0204852 | A1 * | 8/2012 | Boucher | F24C 1/16 126/30 |
| 2013/0334389 | A1 * | 12/2013 | Hill | F16M 13/00 248/346.01 |
| 2014/0238378 | A1 | 8/2014 | Scott | |
| 2015/0308692 | A1 * | 10/2015 | Hurt | F24B 1/195 126/65 |
| 2016/0040889 | A1 | 2/2016 | Rogers | |
| 2016/0153664 | A1 * | 6/2016 | Giuntoli | F24B 3/00 126/73 |
| 2016/0245529 | A1 | 8/2016 | McClean | |
| 2016/0338535 | A1 * | 11/2016 | Witsch | A47J 37/0786 |
| 2017/0114996 | A1 | 4/2017 | Moneyhun et al. | |
| 2017/0205068 | A1 | 7/2017 | Anderson | |
| 2017/0328571 | A1 * | 11/2017 | Despain | F24B 1/205 |
| 2019/0254477 | A1 * | 8/2019 | Skillman | A47J 37/0763 |
| 2020/0096199 | A1 | 3/2020 | Harrington et al. | |
| 2020/0393136 | A1 * | 12/2020 | Johnston | F24C 1/16 |
| 2021/0177203 | A1 * | 6/2021 | Ngo | A47J 37/0763 |
| 2022/0178545 | A1 | 6/2022 | Hale et al. | |
| 2022/0186931 | A1 | 6/2022 | Jan et al. | |
| 2022/0196247 | A1 | 6/2022 | Ressler et al. | |
| 2023/0028945 | A1 | 1/2023 | Jan et al. | |
| 2023/0175697 | A1 | 6/2023 | Tserendorj et al. | |

FOREIGN PATENT DOCUMENTS

| | | |
|---|---|---|
| JP | D1660536 | 5/2023 |
| WO | 2018160767 A1 | 9/2018 |

OTHER PUBLICATIONS

Breeo, LLC, Instagram, Jun. 27, 2022, accessed Jul. 12, 2022 from https://www.instagram.com/tv/CfUm9qiJsBP/.

Breeo, LLC, Instagram, Jun. 29, 2022, accessed Jul. 12, 2022 from https://www.instagram.com/p/CfZzamdJxSy/.

Breeo, LLC, Breeo.co, Breeo Base 1, accessed Jul. 12, 2022 from https://breeo.co/products/breeo-base.

Breeo, LLC, Breeo.co, Breeo Base 2, accessed Jul. 12, 2022 from https://breeo.co/products/breeo-base.

Allgyer, U.S. Appl. No. 29/847,953, filed Jul. 28, 2022.

Northland Online, Deck Defender, accessed Jun. 6, 2023, https://www.northlandmetal.com/products/northland-metal-deck-defender-grass-guard-fire-pit-heat-shield-max.

Cal Flame, Cal Flame Grill Pizza Brick Tray, accessed Jun. 6, 2023, https://www.overstock.com/Home-Garden/Cal-Flame-Grill-Pizza-Brick-Tray/13953388/product.html?opre=1&option=23145998.

Vevor, Fire Pit Heat Shield, 26 x 26 inch Deck Defender & Grass Guard, High Temp Fire Pit Heat Deflector, Fire Pit Mat for Grass Lawn Guarding, Fire Pit Pad for Outdoors, Bonfires, Wood Burning, Square, accessed Jun. 6, 2023, https://www.amazon.com/VEVOR-Fire-Pit-Heat-Shield/dp/B09B6VYSPD.

Allgyer, U.S. Appl. No. 29/877,674, filed Jun. 9, 2023.

Kareturn Fire Pit Protector Base 24 in High Temp Fire Pit Heat Shield Stainless Steel Deck Defender and Grass Lawn Guard for Outdoors, Bonfires, Wood Burning https://www.amazon.com.au/Kareturn-Protector-Stainless-Defender-Outdoors/dp/BOCVXT3KT3 First available on amazon AU Feb. 19, 2024 (Year: 2024).

509 Fabrications, Inc., Revolve Fire Pit Base, accessed and retrieved between May 15, 2023 and May 22, 2023, from https://www.walmart.com/ip/Revolve-Fire-Pit-Base/3994931557, original on sale and original publication date unknown.

Flame Innovation, https://flameinnovation.com/product/revolve-27-base/, retrieved Sep. 14, 2023, captured by waybackmachine Mar. 21, 2023, at https://web.archive.org/web/20230321163154/https://flameinnovation.com/product/revolve-27-base/.

Flame Innovation, LLC, copyright 2023, Revolve, The smokeless fire pit with a twist., retrieved Sep. 14, 2023, from waybackmachine capture dated Jan. 26, 2023, at https://web.archive.org/web/20230126014400/https://revolvefirepit.com/, 2 pages.

A New WordPress Site! Coming Soon!, waybackmachine capture dated Jan. 21, 2023, for https://revolvefirepit. com/, retrieved Sep. 14, 2023, from https://web.archive.org/web/20230121222414/https://revolvefirepit.com/.

* cited by examiner

FIRE PIT SUPPORT

CROSS REFERENCE TO RELATED APPLICATIONS

This application claims the benefit of U.S. Provisional Patent application No. 63/393,138 filed Jul. 28, 2022; the disclosures of which are incorporated herein by reference.

BACKGROUND OF THE DISCLOSURE

1. Technical Field

The disclosure generally relates to structures that are placed under fire pits to protect a surface from the heat generated by the fire pit and, more particularly, to a portable support for a fire pit that allows air to circulate under the fire pit.

2. Background Information

Those who use fire pits often need to place a structure under the fire pit to protect the underlying surface from the heat generated by the fire pit. These structures can be a plurality of bricks, a slab of material such as concrete, or loose gravel. When a fire pit is used on a decking surface, the user needs a structure that prevents the heat from the fire pit from damaging the decking.

SUMMARY OF THE DISCLOSURE

The disclosure provides a fire pit support that is located between the fire pit and the underlying support surface to prevent the underlying support surface from being damaged by the heat generated by the fire pit. In the exemplary configuration, the disclosure provides a fire pit support that provides a heat shield that carries the fire pit above the underlying support surface while allowing air to circulate between the support surface and the heat shield. The heat shield and air circulation prevent the support surface from being damaged by the heat of the fire pit.

The disclosure provides a fire pit support which allows a user to removably place a fire pit on top of a heat shield. In the exemplary configuration, the fire pit support provides a raised lip about the perimeter of the heat shield of the fire pit support to prevent the fire pit from unintentionally sliding off the edge of the fire pit support.

The disclosure also provides a configuration wherein the fire pit support includes water drainage openings that allow water to drain through the fire pit support. The drainage openings are configured to minimize heat that passes through the heat shield.

The disclosure further provides a fire pit support that can be shipped to the end user in a disassembled condition and readily erected by the end user using a typical screwdriver.

The individual features described below may be combined in different combinations than specifically described below to form different configurations of the device of the disclosure. The locations and the numbers of the items can be changed. The preceding non-limiting aspects of the disclosure, as well as others, are more particularly described below. A more complete understanding of the devices, assemblies, and methods can be obtained by reference to the accompanying drawings, which are not intended to indicate relative size and dimensions of the assemblies. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF THE DISCLOSURE

Figure 1:
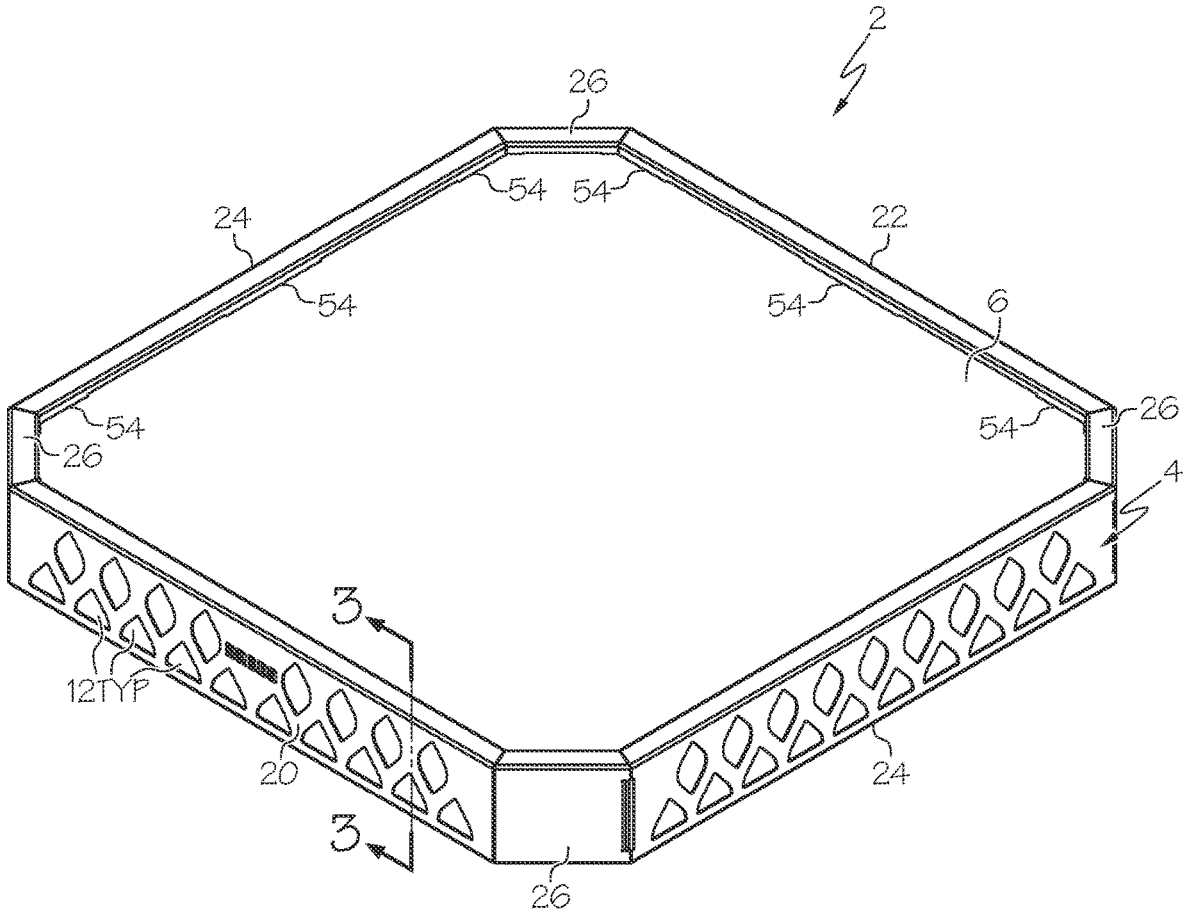
FIG. 1 is a perspective view of an exemplary configuration of the fire pit support.

This description of exemplary embodiments is intended to be read in connection with the accompanying drawings, which are to be considered part of the entire written description. The drawing figures are not necessarily to scale and certain features may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "joined," "connected," and "interconnected," refer to a relationship wherein structures are secured or attached to one another either directly or indirectly through intervening structures, as well as both movable or rigid attachments or relationships, unless expressly described otherwise.

Figure 2:
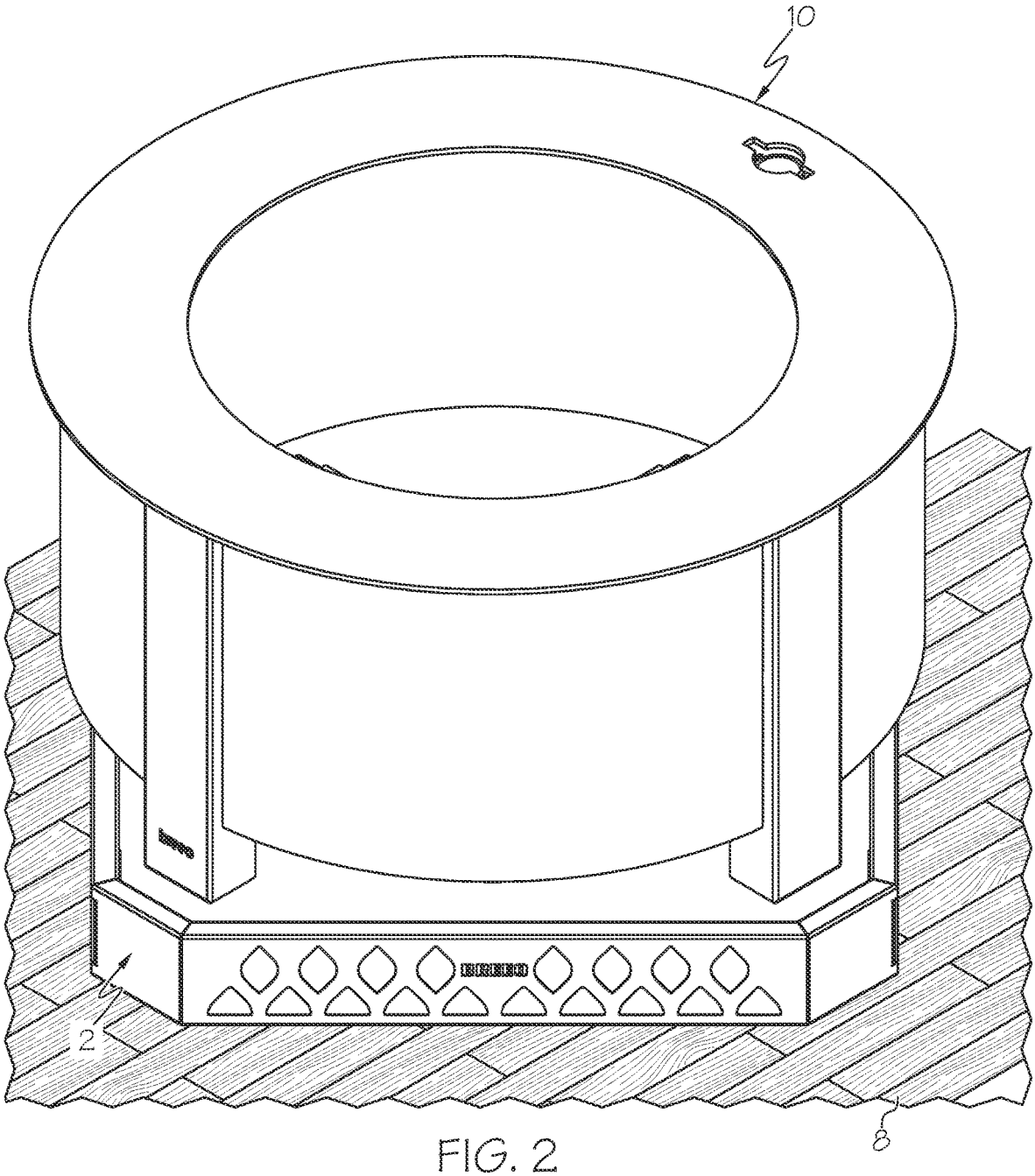
FIG. 2 is a perspective view of a fire pit carried by the fire pit support on a support surface such as a deck surface.

An exemplary fire pit support is indicated generally by the number 2 in the accompanying drawings. Fire pit support 2 generally includes a sidewall 4 and a heat shield 6 that is carried by an upper end of the sidewall 4 spaced above the lower end of sidewall 4 to space heat shield 6 above the support surface 8 upon which fire pit support 2 sits when in use. Sidewall 4 and heat shield 6 are made from metal and can be stainless steel. A fire pit 10 is removably placed on top of heat shield 6 as shown in FIG. 2. With a fire pit 10 that has legs, the bottom of the fire box is spaced from the top of support 2 and the top of support 2 is spaced from the support surface. This configuration provides two air gaps and a solid heat shield 6 to limit the amount of heat transfer to support surface 8. When not in use, fire pit 10 and fire pit support 2 can be separately moved and stored.

In the exemplary configuration, sidewall 4 is generally square in shape when viewed from above and has four angled corners. The width and length are sized to fit the fire pit 10 with which support 2 is to be used. Exemplary configurations are 20.6 inches long and wide for a nineteen inch fire pit 10, 25.6 inches long and wide for a twenty-four inch fire pit 10, and 31.6 inches long and wide for a thirty inch fire pit 10. Exemplary sidewall heights are three to five inches with exemplary heights being 3.5 inches for the smaller (twenty-four inch and under) fire pits 10 and 4.5 inches high for the larger (above twenty-four inches) fire pits 10. Sidewall 4 can be provided in other shapes (when viewed from above) using the features described herein. Non-limiting examples include rectangular, triangular, hexagonal, octagonal, and circular. Sidewall 4 defines a plurality of openings 12 that allow air to flow through sidewall 4.

Figure 5:
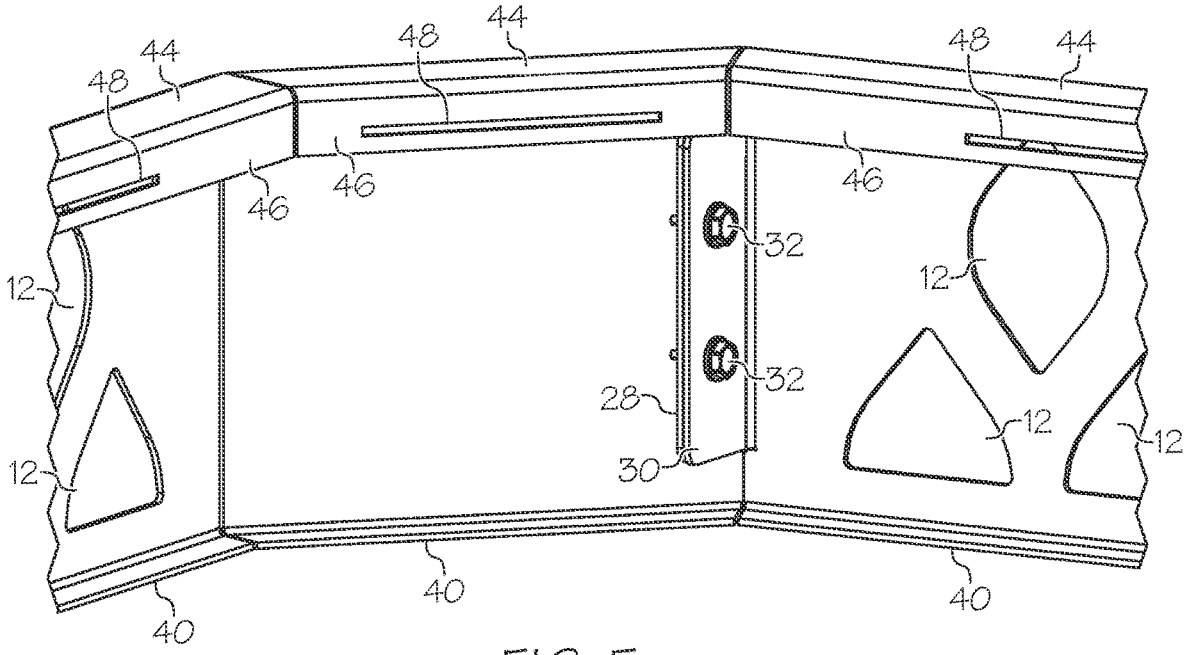
FIG. 5 is a perspective view of the connections between two walls.

In the exemplary configuration, sidewall 4 is made up of a front end wall 20, a rear end wall 22, and two lateral walls 24. Each end wall 20 and 22 includes two angled corner walls 26 which are each angled at forty-five degree angles from the central portions of end walls 20 and 22. Connector flanges 28 (see FIG. 5) project inwardly from the outer end of each corner wall 26. Similarly, connector flanges 30 project inwardly from the ends of lateral walls 24 where they abut connector flanges 28. Mechanical fasteners 32 such as metal screws connect flanges 28 and 30 to join walls 20, 22, and 24 to form sidewall 4.

Figure 3:
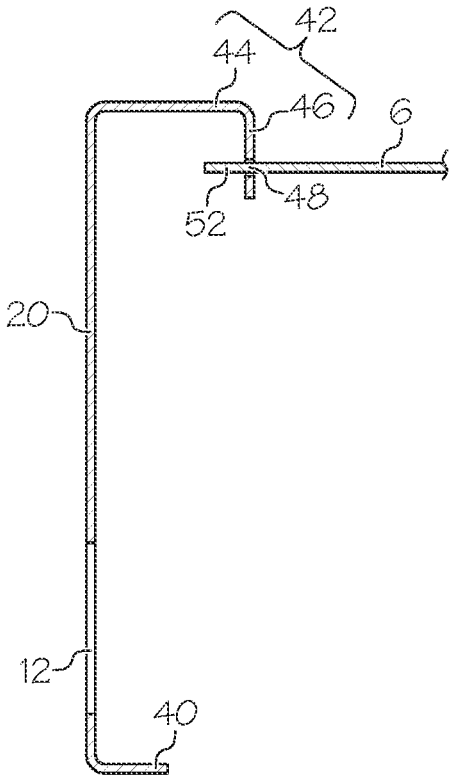
FIG. 3 is a section view of a wall taken along line 3-3 of FIG. 1.
Figure 4:
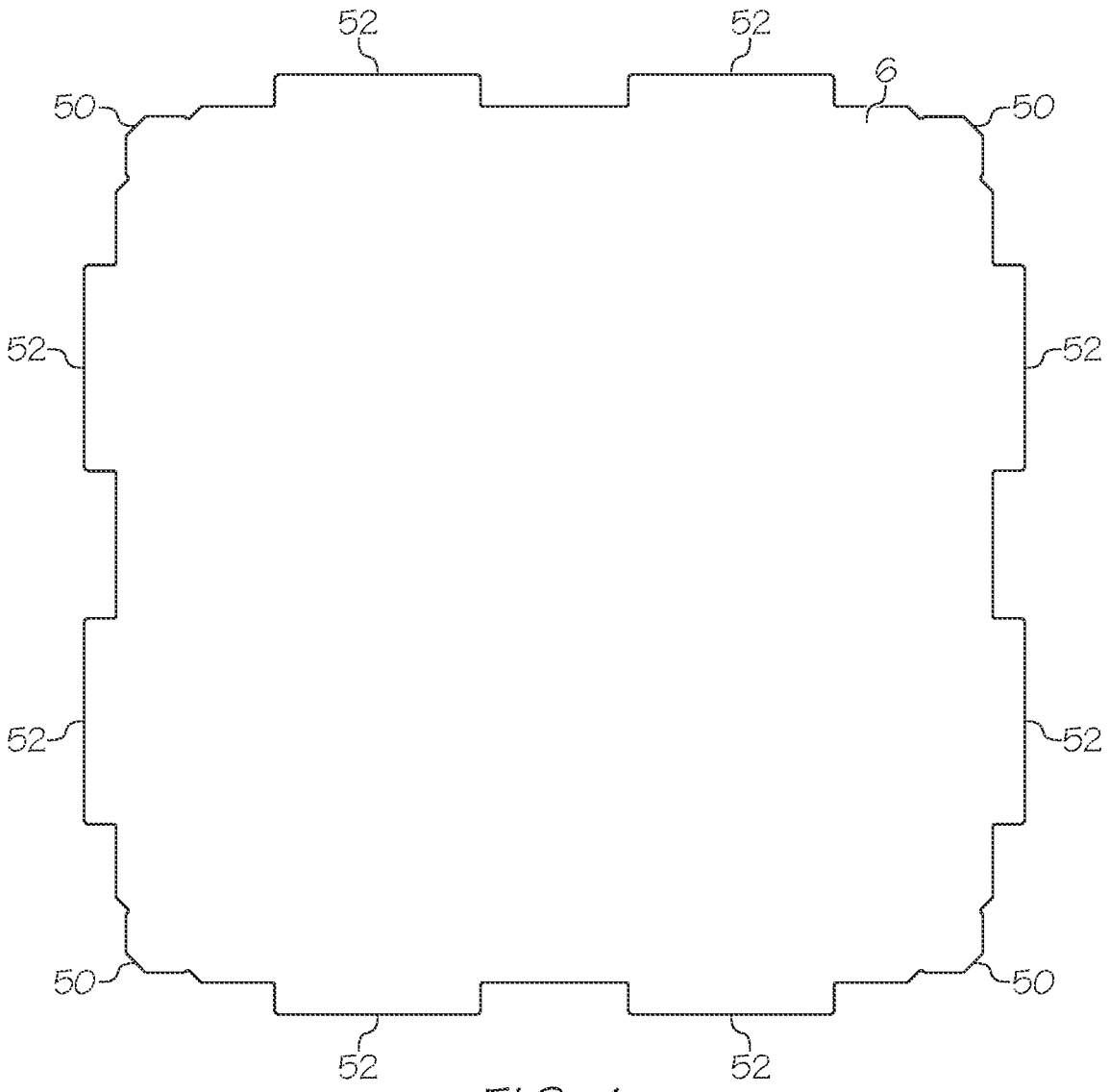
FIG. 4 is a top plan view of the heat shield.

Each wall has a cross section as shown in FIG. 3 with a lower foot 40 and an upper lip 42 defined by an inwardly-projecting upper rim wall 44 and a downwardly projecting slot wall 46. The combination of feet 40 provide a smooth surface that does not damage support surface 8. Each wall 46 defines at least one slot 48 that receives a portion of heat shield 6 to connect heat shield 6 to sidewall 4. As shown in FIG. 4, heat shield 6 includes a plurality of tabs that slide into slots 48. In the exemplary configuration, heat shield 6 includes four corner tabs 50 and eight lateral tabs 52 that are received in corresponding slots 48 when sidewall 4 is assembled to connect heat shield 6 to sidewall 4. The edges of heat shield 6 between tabs 50 and 52 loosely abut or are slightly spaced from slot wall 46 when support 2 is assembled to define drainage gaps 54 through which water can drain from the top of heat shield 6. Drainage gaps 54 are disposed about the perimeter of heat shield 6 and thus do not allow a significant amount of heat from fire pit 10 to pass through heat shield 6. Heat shield 6 otherwise substantially closes the area inwardly of the walls and is free of central openings.

Fire pit support 2 can be shipped unassembled and erected by assembling walls 20 and 24 about heat shield. Fasteners 32 are added to complete the assembly.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Modifications and alterations of those embodiments will be apparent to one who reads and understands this general description. The present disclosure should be construed as including all such modifications and alterations insofar as they come within the scope of the appended claims or equivalents thereof. Throughout the description and claims of this specification the words "comprise" and "include" as well as variations of those words, such as "comprises," "includes," "comprising," and "including" are not intended to exclude additives, components, integers, or steps.

The invention claimed is:

1. A support for a fire pit that shields a support surface from the heat of the fire pit, the support comprising:

a heat shield adapted to support the fire pit;

a sidewall assembly having an upper end portion and a lower end portion; the heat shield carried by the upper end portion of the sidewall assembly;

the heat shield being spaced from the lower end portion;

the upper end portion of the sidewall assembly defining a plurality of slots;

the heat shield including a plurality of tabs located in the slots of the sidewall assembly;

the heat shield and sidewall assembly cooperating to define drainage gaps between the tabs adjacent the sidewall assembly;

the upper end of the sidewall assembly defining an upper lip that extends around and above the heat shield; and the upper lip including an inwardly-projecting upper rim wall and a downwardly projecting slot wall that defines the plurality of slots.

2. The support of claim 1, wherein the heat shield has a central area adapted to be disposed under the fire pit; the central area of the heat shield being free of openings.

3. The support of claim 1, wherein the heat shield has four sides with two side tabs projecting from each side; a drainage gap defined along each side of the heat shield between the two side tabs and the sidewall assembly.

4. The support of claim 3, wherein the heat shield has four angled corners; a corner tab projecting from each angled corner; a drainage gap defined between each corner tab and one of the side tabs and the sidewall assembly.

5. The support of claim 4, wherein the sidewall assembly defines a perimeter lip above the heat shield.

6. The support of claim 1, wherein the sidewall and heat shield define an open air space below the heat shield inwardly of the sidewall assembly.

7. The support of claim 6, wherein the sidewall assembly defines openings such that air can enter and leave the open space below of the heat shield.

8. The support of claim 1, wherein the sidewall and heat shield define an open air space below the heat shield inwardly of the sidewall assembly.

9. The support of claim 8, wherein the sidewall assembly defines openings such that air can enter and leave the open space below of the heat shield.

10. A support for carrying a fire pit above a support surface; the support comprising:

a sidewall assembly having an upper end portion and a lower end portion;

the lower end portion of the sidewall adapted to engage the support surface;

a heat shield carried by the upper end portion of the sidewall to define an open area below the heat shield and inwardly of the sidewall assembly;

the heat shield defining drain openings;

wherein the sidewall assembly includes:

a front end wall;

a rear end wall;

two lateral walls;

each of the front and rear end walls having two angled corner walls which are each angled at forty-five degree angles from central portions of the front and rear end walls;

first connector flanges projecting inwardly from an outer end of each corner wall;

second connector flanges projecting inwardly from ends of lateral walls;

the second connector flanges of the lateral walls abut the first connector flanges; and fasteners connecting the first flanges to the second flanges.

11. The support of claim 10, wherein the drain openings are located adjacent to the sidewall assembly.

12. The support of claim 11, wherein the heat shield has a central portion that is free of openings.

13. The support of claim 10, wherein the heat shield is spaced three to five inches above the lower end portion of the sidewall assembly.

14. The support of claim 10, further comprising a lower foot projecting inwardly from the lower end portion of the sidewall assembly.

15. The support of claim 10, wherein the sidewall assembly defines a plurality of openings that vent the open area below the heat shield.

16. A support for a fire pit that shields a support surface from the heat of the fire pit, the support comprising:

a heat shield adapted to support the fire pit;

a sidewall assembly having an upper end portion and a lower end portion; the heat shield carried by the upper end portion of the sidewall assembly;

the heat shield being spaced from the lower end portion;

the upper end portion of the sidewall assembly defining a plurality of slots; and the heat shield including a plurality of tabs located in the slots of the sidewall assembly;

the heat shield having four sides with two side tabs projecting from each side; a drainage gap defined along each side of the heat shield between the two side tabs and the sidewall assembly; and the heat shield having four angled corners; a corner tab projecting from each angled corner; a drainage gap defined between each corner tab and one of the side tabs and the sidewall assembly.

17. The support of claim 16, wherein the sidewall assembly defines a perimeter lip above the heat shield.

18. The support of claim 16, wherein the sidewall and heat shield define an open air space below the heat shield inwardly of the sidewall assembly.

19. The support of claim 18, wherein the sidewall assembly defines openings such that air can enter and leave the open space below of the heat shield.

* * * * *